US006979192B2

(12) United States Patent
Ikuta et al.

(10) Patent No.: US 6,979,192 B2
(45) Date of Patent: Dec. 27, 2005

(54) BURNER HEAD AND GAS BURNING APPLIANCE PROVIDED WITH SUCH A BURNER HEAD

(75) Inventors: Minoru Ikuta, Hyogo (JP); Kozo Uehara, Kakogawa (JP); Shunji Tanba, Akashi (JP); Akinobu Nakamura, Himeji (JP)

(73) Assignee: Noritz Corporation, Hyogo (JP)

( * ) Notice: Subject to any disclaimer, the term of this patent is extended or adjusted under 35 U.S.C. 154(b) by 1 day.

(21) Appl. No.: 10/600,196

(22) Filed: Jun. 20, 2003

(65) Prior Publication Data

US 2004/0115580 A1 Jun. 17, 2004

(30) Foreign Application Priority Data

Dec. 11, 2002 (JP) ..... 2002-359159

(51) Int. Cl.[7] ..... F23D 14/62
(52) U.S. Cl. ..... 431/354
(58) Field of Search ..... 431/160, 284, 431/354, 326, 328, 329; 29/890.02

(56) References Cited

U.S. PATENT DOCUMENTS

| | | | | |
|---|---|---|---|---|
| 3,412,940 A | * | 11/1968 | Tredicesimo | 239/553 |
| 3,758,265 A | * | 9/1973 | Hein | 431/349 |
| 4,029,936 A | * | 6/1977 | Schweitzer | 219/267 |
| 4,048,290 A | * | 9/1977 | Lee | 423/336 |
| 4,624,631 A | * | 11/1986 | Kobayashi et al. | 431/9 |
| 5,104,309 A | * | 4/1992 | Krieger | 431/328 |
| 6,325,619 B2 | * | 12/2001 | Dane | 431/284 |
| 6,769,176 B2 | * | 8/2004 | Hornby | 29/890.09 |
| 2001/0036610 A1 | * | 11/2001 | Wood | 431/328 |

FOREIGN PATENT DOCUMENTS

| | | | |
|---|---|---|---|
| EP | 0 308 110 | * 3/1989 | F23D 14/26 |
| GB | 2 143 024 | * 1/1985 | F23D 15/00 |
| JP | 55-152307 | * 11/1980 | F23D 13/10 |
| JP | 62-134409 | 6/1987 | |
| JP | 07-127819 | 5/1995 | |
| JP | 07-158822 | 6/1995 | |
| JP | 07-190317 | 7/1995 | |
| JP | 08-233223 | 9/1996 | |
| JP | 11-063432 | 3/1999 | |

* cited by examiner

*Primary Examiner*—Stephen Gravini
(74) *Attorney, Agent, or Firm*—Jordan and Hamburg LLP

(57) ABSTRACT

Disclosed is a burner head capable of securing heat resistance and durability characteristics and improving the quality of machining at the same time, capable of easily and stably machining a material into a complicated shape. A second metal primary material of the iron family having high workability and first metal primary materials of the SUS family having high heat resistance are rolled out. Their side plate ends are butt-welded by laser to form a one-piece metal flat-plate material. A press molding machine is operated to press mold recessed portions of a pair of plate members simultaneously with cutting along a contour line. Then, folding is carried out, and they are closely joined together. A gas passage is formed by a recessed portion of the second metal primary material section. A burner port is formed by a recessed portion of the first metal primary material section.

8 Claims, 5 Drawing Sheets

BURNER HEAD AND GAS BURNING APPLIANCE PROVIDED WITH SUCH A BURNER HEAD

BACKGROUND OF THE INVENTION

1. Field of the Invention

The present invention generally relates to a burner head for use in gas burning appliances such as water heaters, combustion equipment, et cetera. This invention relates more particularly to a burner head formed by joining together press-molded metal plate materials.

2. Description of the Related Art

It is well known in the prior art to form a burner head for use in gas burning appliances, first by superimposing inner and outer plates to be disposed interiorly and then by joining together the plates to a unit by means of spot welding or laser welding from the side (see Japanese Patent laid open Gazette No. 7(1995)-158822). More specifically, the inner and outer plates are each formed by press molding a sheet of metal material plate and the thus press-molded metal material plates are placed one over the other and are assembled together. Thereafter, the plates are welded together in the way as described above.

SUMMARY OF THE INVENTION

In the above-described conventional burner head, all of plates constituting the burner head are each formed by press molding of a single sheet of metal plate material of high heat resistance (e.g., material of the stainless steel family). This means that complicated recessed portions and recessed grooves for forming burner ports, gas passages, and so on must be formed by press molding of the above-described material which is relatively hard and poor in workability. This accordingly causes difficulties in providing stable and exact formation of a gas passage having a complicated shape. In addition, the occurrence of cracking may cause impairment of the process yield. Furthermore, the material used is costly, thereby increasing the production cost (material cost) of a burner head, and the production cost of gas burning appliances provided with a burner head is likely to increase.

Bearing mind in the above-described circumstances, the present invention was made. Accordingly, a major object of the present invention is to provide a burner head and gas burning appliance capable of making the ensuring of heat resistance and durability characteristics compatible with the improvement in the quality of machining, capable of easily and stably machining a material into a complicated shape, and capable of reducing the cost of production.

In order to achieve the above object, the present invention basically employs the following problem-solving means. To sum up, the wall material, of which a burner port, a gas passage, et cetera of a burner head are formed, is not comprised of a single kind of primary material, in other words the wall material is comprises of different primary materials of different characteristics suitable for the formation of a burner port and for the formation of a gas passage, respectively.

A first invention provides a specific problem-solving means which relates to a burner head. More specifically, this problem-solving means is directed to a burner head comprising a gas passage and a burner port which are formed, by joining together oppositely-arranged plate members either or both of which are provided with recessed potions having shapes corresponding to the gas passage and to the burner port respectively, between the plate members. In the burner head of the first invention, regions of at least one of the plate members that is provided with the recessed portions, for formation of the gas passage and the burner port, are each formed of a respective metal primary material having characteristics selected according to each region, and the entire plate member is formed of a single sheet of metal flat-plate material formed by uniting different types of plate-like metal primary materials having different characteristics.

In accordance with the first invention, the plate member used to form a burner head is formed of metal primary materials having characteristics suitable for a region for formation of a burner port and for a region for formation of a gas passage respectively. Stated another way, the burner-port constituting region is comprised of a metal primary material of high heat resistance and, on the other hand, the gas-passage constituting region is comprised of a metal primary material suitable for machining of a complicated shape. As a result of such arrangement, while allowing the burner head to maintain adequate heat resistance and durability characteristics, it is possible to form a complicated shape with accuracy and ease. Therefore, it becomes possible to manufacture and provide a high-performance, high-quality burner head. Besides, it is unnecessary to use an expensive metal primary material of high heat resistance for the entire plate member. Lowering the cost of material reduces the cost of production.

By "characteristics selected according to each region" is meant characteristics selected in consideration of minimum required characteristics, optimum characteristics, characteristics acceptable for the cost of material and so on. Additionally, it suffices if, when a plate member provided with recessed portions having shapes corresponding to a gas passage and to a burner port respectively and a flat plate member are arranged opposing each other and are joined together, the former plate member in which the recessed portions are formed is comprised of a metal flat-plate material as set forth in the present invention. On the other hand, it suffices if, when a pair of plate members both of which are provided with recessed portions are arranged opposing each other and are joined together, the pair of plate members are each comprised of a metal flat-plate material of the present invention.

In an example of an embodiment of the first invention, the metal flat-plate material comprises a combination of a first metal primary material having high heat resistance and a second metal primary material having high workability characteristics, and the burner-port constituting region (for example, the burner port and regions in the vicinity of the burner port) and the gas-passage constituting region are formed, by press molding, in a first section of the metal flat-plate material which is formed of the first metal primary material and in a second section of the metal flat-plate material which is formed of the second metal primary material, respectively. As a result of such arrangement, it becomes possible to realize the characteristics of a metal primary material to be selected according to each of the burner-port and gas-passage constituting regions. This further ensures realization of the operation/working-effect of the present invention.

Furthermore, the metal flat-plate material, used to form a plate member of a burner head of the present invention, is concretely specified in the light of its manufacture method. The metal flat-plate material is manufactured by uniting, by means of butt welding, different types of plate-like metal primary materials at end edges thereof in the same plane. This ensures formation of a metal flat-plate material by the use of different types of metal primary materials of different characteristics for each region. Furthermore, a butt welding operation in this case will be specified. End edges of each of the plural plate-like metal primary materials extend straightway, and it is set such that a butt-welding region of the metal flat-plate material extend straightway, and it is set such that the butt-welding region is located at such a position between the burner-port constituting region and the gas-passage constituting region that the variation in shape of each of the burner-port and gas-passage constituting regions becomes minimum. This makes it possible to stabilize not only the quality of a section of the metal flat-plate material extending as the butt-welding region but also the quality of a plate member having a welding region. Besides, possible harmful effects due to the presence of a butt-welding region are also eliminated. Furthermore, as the foregoing butt welding, TIG (Tungsten Insert Gas) arc welding may be employed. Also, laser welding may be employed. Since the above-described welding technique in which base metals of metal primary materials are melted and welded together is employed, this makes it possible to form a plate member using only the original metal primary material which does not contain materials such as welding materials.

A second invention provides a problem-solving means which relates to a gas burning appliance. The gas burning appliance of the second invention employs a burner head according to the first invention which has been described as a gas burning appliance. In accordance with the second invention, the burner head maintains resistance to high heat and durability characteristics and is provided with a gas passageway formed with high dimensional accuracy because of the improvement in workability. This makes it possible to provide a gas burning appliance of stable combustion performance quality. In addition, by virtue of lowering the cost of production of a burner head, the total cost of production of a gas burning appliance is also reduced.

DETAILED DESCRIPTION OF THE PREFERRED EMBODIMENTS

Hereinafter, embodiments of the present invention will be described with reference to the drawings.

Figure 1:
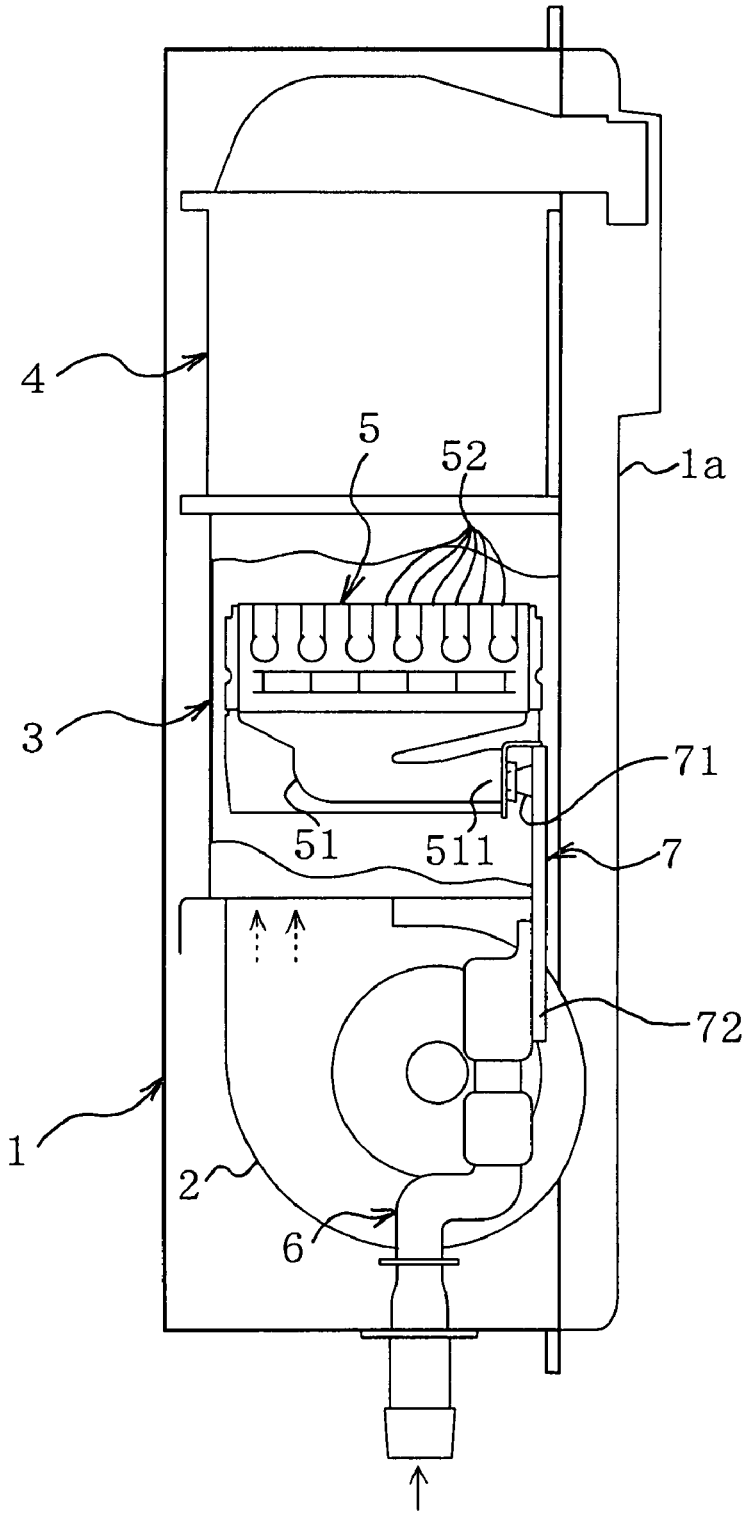
FIG. 1 is a simplified cross-sectional explanatory diagram of a water heater to which an embodiment of the present invention is applied.

Referring first to FIG. 1, there is shown an instantaneous gas water heater as a gas burning appliance provided with a burner head according to an embodiment of the present invention. The reference numeral 1 denotes a housing. The reference numeral 1*a* denotes a front cover of the housing 1. The reference numeral 2 denotes a air blower fan for supplying air for combustion. The reference numeral 3 denotes a combustion storage water heater body in which is contained a combustion burner. The reference numeral 4 denotes a heat exchange storage water heater body disposed above the combustion storage water heater body 3 and containing therein piping of a heat exchanger (not shown). Tap water is fed into the heat exchanger. Hot water heated by combustion heat in the combustion storage water heater body 3 is supplied to a hot water tap or the like.

A predetermined number of burner heads 5 (not less than two) constituting a combustion burner are arrayed side by side within the combustion storage water heater body 3, in other words, the burner heads 5 are disposed on the far side (in the direction orthogonal to the paper surface of FIG. 1) of the combustion storage water heater body 3. Interposed between these burner heads 5 and a fuel gas supply system 6 is a manifold unit 7. By virtue of the manifold unit 7, fuel gas from the fuel gas supply system 6 is distributed individually to each burner head 5.

Figure 2:
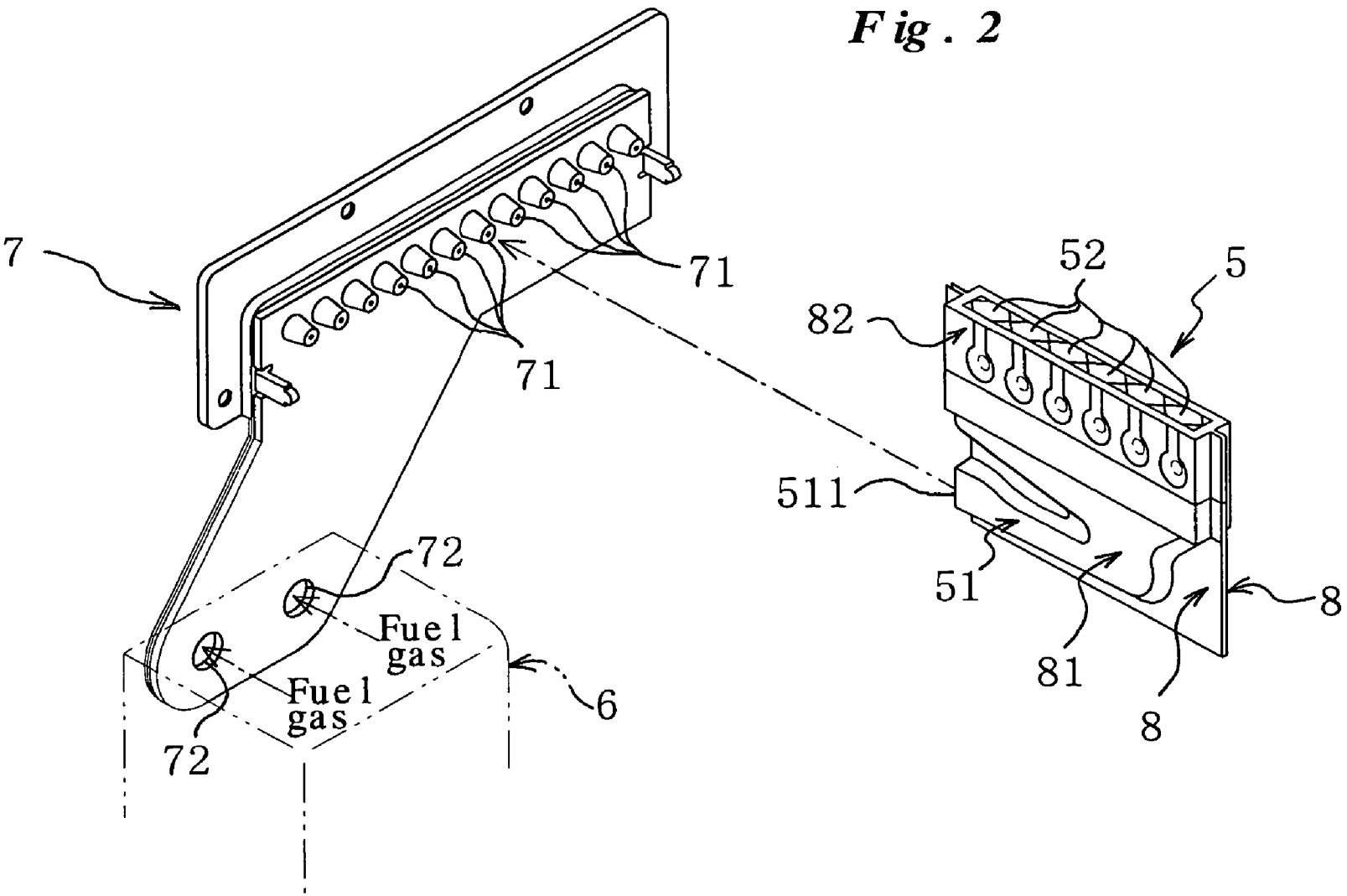
FIG. 2 is an exploded perspective view of a burner head and a manifold unit.

Each burner head 5, as shown in FIG. 2, comprises a gas passage 51 having an opening 511 extending toward an end of a corresponding nozzle part 71 of the manifold unit 7 and disposed face to face with the nozzle part 71 with a predetermined gap therebetween, and burner ports 52 opening upwardly by which a mixture of fuel gas and air introduced from the gas passage 51 is burned together with air drawn thereinto. FIG. 2 shows only one burner head 5. Each burner head 5 is connected to a respective nozzle part 71.

The fuel gas supply system 6 supplies fuel gas, pressure-delivered through a city gas pipe or from a gas container (not shown), to main gas supply ports 72, 72 of the manifold unit 7 (see FIG. 2). The thus-supplied fuel gas passes through an internal passage of the manifold unit 7 and is ejected toward the opening 511 of the gas passage 51 of the burner head 5 from the nozzle part 71. During ejection of the fuel gas in the direction of the opening 511, air forced into the combustion storage water heater body 3 by the air blower fan 2 (see FIG. 1) is drawn from the gap to form a fuel-gas mixture and, at the same time, is introduced to the gas passage 51.

Figure 3:
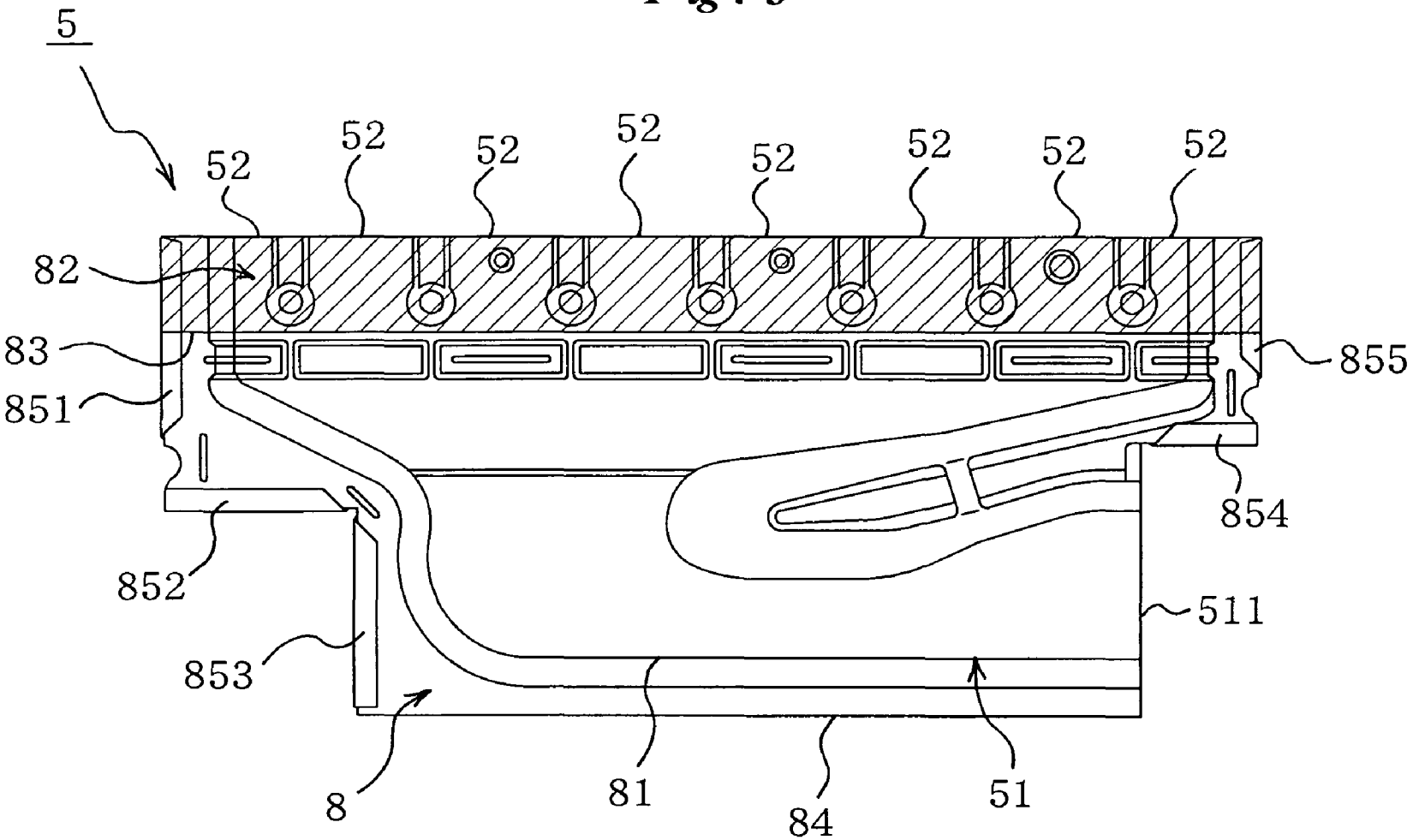
FIG. 3 is a top plan view of the burner head.

FIG. 3 shows details of a burner head 5. The burner head 5 comprises at least a pair of plate members 8, 8. More specifically, the burner head 5 is formed by superimposing a pair of plate members 8, 8 arranged opposing each other and then by joining them together (see also FIG. 1). Each plate member 8 is provided with recessed portions 81, 82 from which the gas passage 51 and each burner port 52 are formed by press molding of a specified metal flat-plate material 9 which is described later. The plate members 8, 8 are arranged opposing each other and joined together, whereby the gas passage 51 and the burner ports 52 are divisionally formed between the recessed portions 81, 81, 82, 82. In each plate member 8, the recessed portion 81 corresponds to a region constituting a gas passage 51 and the recessed portion 82 corresponds to a region constituting a burner port 52.

More specifically, in each plate member 8 the recessed portion 81 is shaped like a groove and its upstream end side opens at the opening 511 of the gas passage 51. The recessed portion 81 extends to one side from a portion corresponding to the opening 511 and then curves upwardly so that its downstream end side expands in the width direction (horizontal direction of FIG. 3). On the other hand, the recessed portion 82 is formed such that it communicates with the downstream end side of the recessed portion 81 for division of the burner ports 52 and opens upwardly (FIG. 3).

Each plate member 8 comprises a first region on the burner port's 52 side (indicated by hatching in FIG. 3) and a second region on the gas passage's 51 side. The first and second regions face each other across a boundary 83 extending straightway between the section of each burner port 52 and the section of the gas passage 51 in the width direction. The first region is formed of a first metal primary material of high heat resistance and the second region is formed of a second metal primary material of high workability. In other words, the section constituting each burner port 52 is comprised of a material of high heat resistance in order to secure heat resistance and durability characteristics and, on the other hand, the section constituting the gas passage 51 is comprised of a material having rather high workability than heat resistance in order to secure dimensional accuracy of the complicated recessed portion 81 for the gas passage 51 formed by press molding. As the first metal primary material, materials of the stainless steel family (e.g., SUS430) may be employed. On the other hand, as the second metal primary material, materials of the iron family (e.g., aluminized steel) may be employed.

Furthermore, the position of the boundary 83 is so set as to extend straightway at where the recessed portion 82 or recessed portion 81 formed in the plate member 8 by press molding undergoes a minimum concave/convex shape variation. In the FIG. 3 case, the position is a boundary between the recessed portion 82 and the recessed portion 81, and it is set such that the boundary 83 is extended where the greater portion exclusive of the vicinity of both the side end portions in the width direction becomes a concave bottom.

Formation of a burner head 5 of the type described above comprises a first step in which a first metal primary material and a second metal primary material are united into a single unit (i.e., in the form of a sheet of metal flat-plate material), a second step in which a plate member 8 is formed by subjecting the metal flat-plate material to a press molding process for formation of shapes of recessed portions 81, 82 and by cutting from the metal flat-plate material, and a third step in which plate members 8, 8 are joined together to assemble a burner head 5.

Figure 4:
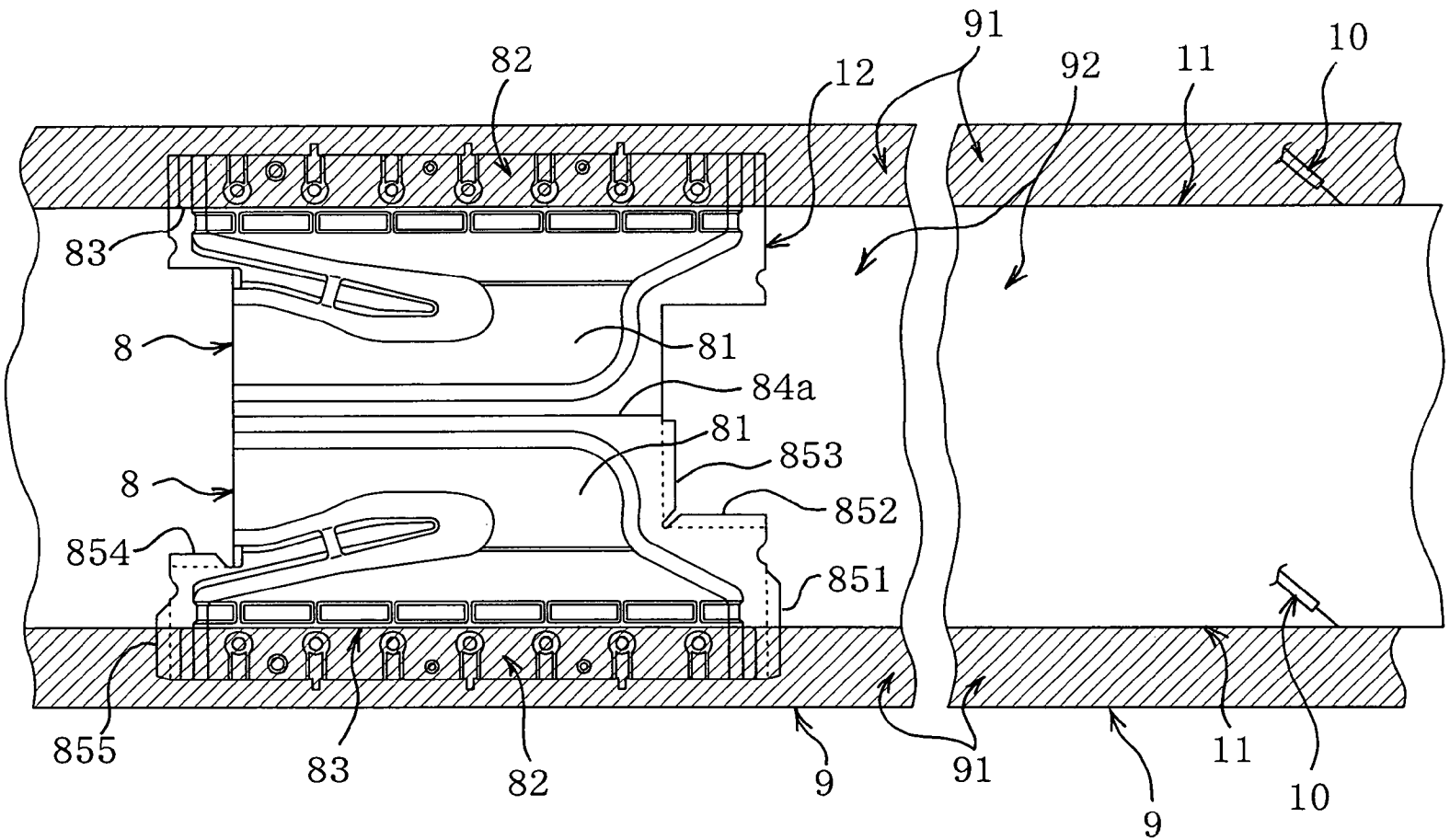
FIG. 4 is a top plan view for providing an explanation of a method of manufacture for the burner head of FIG. 3.

The above will be described more specifically. Referring now to FIG. 4, there is illustrated a case in which a united body, made up of a pair of plate members 8, 8 continuously connected together at their lower edge portions 84 (see FIG. 3), is formed by press molding. In the first place, a second band plate-like metal primary material 92 is rolled out from a roll to a middle position. At the same time, first band plate-like metal primary materials 91 (band plate-like sections indicated by hatching in FIG. 4) are likewise rolled out from respective rolls so that they are located on both sides of the second metal primary material 92. These three metal primary materials 91, 92, 91 are conveyed, at constant velocity, from the respective rolls (the right-hand side in FIG. 4) toward the downstream side (the left-hand side in FIG. 4). And, the adjoining plate ends are butted against each other in the same plane and these butted portions are butt welded by means of laser welding machines 10, 10. This forms a metal flat-plate material 9 with its butt welding regions 11, 11 extending straightway toward the downstream side.

In the next place, the metal flat-plate material 9 is passed to the downstream side at a constant velocity and, in synchronization with this, a press molding machine (not shown) is operated to form recessed portions 81, 81, 82, 82 at predetermined positions. This is followed by cutting along a contour line 12. At this time, the relative position relationship between the press molding machine and the metal flat-plate material 9 is set such that each butt welding region 11 is located in the boundary 83 of FIG. 3.

And, a folding operation is carried out along a folding line 84*a* so that the plate members 8, 8 are located face to face with each other. Then, the plate members 8, 8 are closely joined together. Additionally, joint flange portions 851–855 are folded from one side so as to embrace the other ones, and they are closely joined together. In the way as described above, the burner head 5 is formed.

As has been described above, since the recessed portion 81 which becomes a gas passage 51 is press molded in the second metal primary material 92 of high workability, this makes it possible to form the recessed portion 81 into an exact shape by a high dimensional accuracy machining process. This prevents not only the variation in the quality of machining but also the occurrence of defective products, thereby making it possible to provide improvements in the quality of machining. Besides, because of realization of a shape as designed it becomes possible to provide a combustion performance as intended. Furthermore, since the recessed portion 82 which becomes a burner port 52 is formed of the first metal primary material 91 of high heat resistance, this makes it possible for the burner head 5 to maintain the same heat resistance and durability characteristics as previously.

In the case that an inner plate member is imposed between a pair of plate members 8, 8 joined together as the burner head 5, preferably the inner plate member is formed such that, as in each plate member 8 described above, a region on the side of the burner port 52 is formed of the first metal primary material and a region on the side of the gas passage 51 is formed of the second metal primary material.

Figure 5:
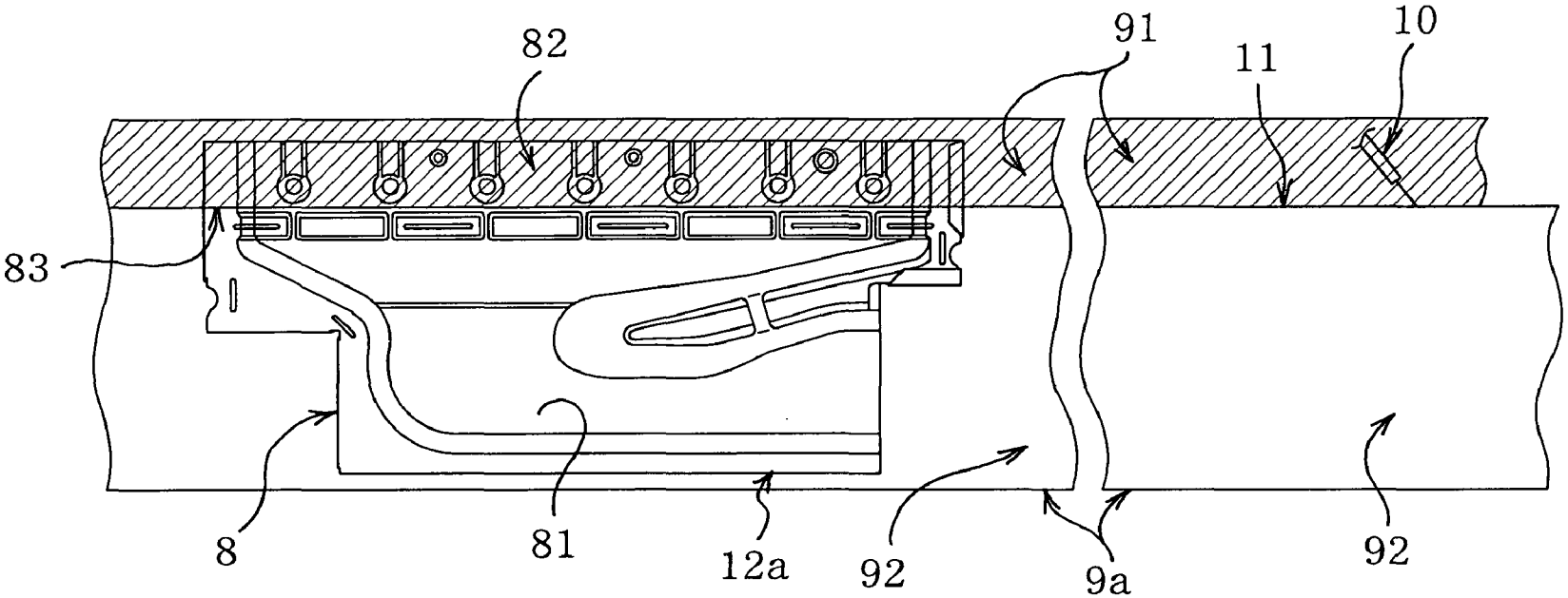
FIG. 5 is a diagram similar to FIG. 4 but shows a different manufacture method from the one shown in FIG. 4.

It should be noted that the present invention is not limited to the foregoing embodiment. The present invention includes other various embodiments. In the foregoing embodiment, a pair of plate members 8, 8 in the form of a one-piece body is press molded. However, it may be arranged such that press molding is carried out for each plate member 8. In this case, for example as shown in FIG. 5, it suffices if a first band plate-like metal primary material 91 and a second band plate-like metal primary material 92 are adjacently passed from the right-hand side to the left-hand side of FIG. 5, and their plate ends are butt welded together by a laser welding machine 10 to form a metal flat-plate material 9*a*. Then, a metal mold corresponding to a single plate member 8 is used to form recessed portions 81, 82 by press molding. Cutting is carried out along a contour line 12*a*. An another plate members 8 thus press molded and cut are joined together with the above single plate member 8.

Finally, in the foregoing embodiments the description has been made in terms of the case in which the metal flat-plate material 9 (9*a*) is passed or run while being subjected to a press molding process, which however is not deemed restrictive. Alternatively, it may be arranged such that a rectangular metal flat-plate material having a given length is formed by a separate step and press molding is carried out for each metal flat-plate material in the next step.

What is claimed is:

1. A burner head comprising:

a gas passage and a plurality of burner ports;

first and second planar metal sheets, each sheet having an internal face, each sheet comprising first and second portions, said first and second portions connecting at a substantially linear boundary, said first portion is formed of a first metal material and second portion is formed of a second metal material, said first material being different from said second material;

said first portion of said first sheet including a depression for defining a portion of said plurality of burner ports and said second portion of said second sheet including a depression for defining a portion of said gas passage, said gas passage connecting with said burner ports at said boundary;

said first portion of said second sheet including a depression for defining a further portion of said plurality burner ports and said second portion of said first sheet including a depression for defining a further portion of said gas passage, said gas passage connecting with said burner ports at said boundary; and said internal face of said first sheet connecting against said internal face of said second sheet for forming said gas passage and said plurality of burner ports.

2. The burner head as set forth in claim 1, wherein:

said metal flat-plate material is a combination of a first metal primary material having high heat resistance and a second metal primary material having high workability, and said burner-port constituting region and said gas-passage constituting region are formed, by press molding, in a first section of said metal flat-plate material which is formed of said first metal primary material and in a second section of said metal flat-plate material which is formed of said second metal primary material, respectively.

3. The burner head as set forth in either claim 1 or claim 2, wherein:

said metal flat-plate material is comprised of different types of plate-like metal primary materials of different characteristics, said different types of plate-like metal primary materials being united together at end edges thereof in the same plane by butt-welding.

4. The burner head as set forth in claim 3, wherein:

each said end edge of said plurality of plate-like metal primary materials extends straightway so that a butt-welding region of said metal flat-plate material extends straightway, and said butt-welding region is located at such a position between said burner-port constituting region and said gas-passage constituting region that said burner-port and gas-passage constituting regions each undergo a minimum variation in shape.

5. The burner head as set forth in claim 3, wherein:

said butt-welding operation is carried out by laser welding.

6. A gas burning appliance comprising a burner head as set forth in any one of claim 1 or 2.

7. The burner head of claim 1, wherein said first and second planar sheets are a single sheet joined at a centerline.

8. The burner head of claim 1, wherein said first and second planar sheets are separate sheets.

* * * * *